US006289954B1

(12) United States Patent
Harper

(10) Patent No.: US 6,289,954 B1
(45) Date of Patent: Sep. 18, 2001

(54) VENEER PRODUCT AND PROCESS

(76) Inventor: Ernest V. Harper, 2412 Quirt La., Port Charlotte, FL (US) 33983

( * ) Notice: Subject to any disclaimer, the term of this patent is extended or adjusted under 35 U.S.C. 154(b) by 129 days.

(21) Appl. No.: 09/586,758

(22) Filed: Jun. 5, 2000

Related U.S. Application Data

(60) Provisional application No. 60/168,716, filed on Dec. 6, 1999, and provisional application No. 60/144,281, filed on Jul. 1, 1999.

(51) Int. Cl.[7] ..... B27C 1/00

(52) U.S. Cl. ..... 144/180; 144/162.1; 144/176; 144/185; 144/174; 144/373

(58) Field of Search ..... 144/162.1, 176, 144/180, 485, 188, 373, 172, 174; 241/34, 92, 98, 278.1, 151, 280

(56) References Cited

U.S. PATENT DOCUMENTS 1,799,814 * 4/1931 Hommel ..... 144/188
2,349,034 * 5/1944 Elmendorf ..... 144/185
2,727,542 * 12/1955 Fischer ..... 144/180
2,796,094 * 6/1957 Himmelheber et al. ..... 144/180
6,152,200 * 11/2000 Smothers ..... 144/180

* cited by examiner

*Primary Examiner*—W Donald Bray
(74) *Attorney, Agent, or Firm*—Frank A. Lukasik

(57) ABSTRACT

A system for converting wood products into viable base construction materials consisting of a support structure, a central structure consisting of a low speed, high torque, hydraulic motor which drives a central drive shaft to which a planing table is rotatably attached. Four or more feed chutes are radially attached to the outer supports and the logs are sliced over eight blades arranged on the planing table. An alternative embodiment consists of a rotary cutting device where logs are fed to cutting blades rotating below.

7 Claims, 14 Drawing Sheets

VENEER PRODUCT AND PROCESS

This application claims the benefit of U.S. Provisional Application No. 60/168,716, filed Dec. 6, 1999, and U.S. Provisional Application No. 60/144,281, filed Jul. 1, 1999.

BACKGROUND OF THE INVENTION

1. Field of the Invention

The invention relates to machinery for the conversion of wood products into viable base construction materials and more specifically, the invention relates to a planing machine to convert small diameter, short logs, or split logs into construction materials without generating waste.

2. Discussion of the Prior Art

Currently available log processing machines, grind, crush, chip, or chop logs, severely degrading their wood fibers and their strength. The methods used in industry to produce veneers is limited to the use of logs of substantial size. Smaller logs are wasted because they cannot be processed with existing machinery.

The instant invention is designed to exploit the valuable physical characteristics of veneered wood which is commercially produced by slicing thin veneer sheets from wooden logs. The rotary planing table and feed chutes of the instant invention were designed to slice short, small diameter, split logs into thin sheets of veneer without creating waste. The veneer strips can thereafter be split and cut to uniform shapes for processing into laminated veneer building products, such products are inherently superior to their solid wood counterparts.

SUMMARY OF THE INVENTION

The invention consists of a substantial support structure comprised of four or more outer legs which support a central structure consisting of a low speed, high torque, hydraulic motor, or equivalent, which drives a central drive shaft to which a planing table is rotatably attached to its distal end. Four or more feed chutes are radially attached to the outer supports so that their open bottom ends can guide the logs to be sliced over the eight blades radially arranged on the planing table. The design is such that the planing table rotates beneath the lower ends of the chutes and by so doing causes the cutting blades to cut very thin slices from the logs in the chutes. The slices pass through the planing table by way of narrow slots beneath the cutting edges of the blades and fall to a conveyer belt or other removal means for transfer to other areas for further processing. The capacity of the rotary table planing machine is determined by the number of log feed chutes, the number of planing (veneering) blades built into the rotary planing table, the size of the logs and the rotational speed of the rotary planing table. Output volume is directly related to the thickness of the veneer slats produced.

Having only one moving part, the rotating planing table, reliability is maximized and by separating the feeding of logs into the top and the removal of veneer strips from the bottom of the machine, congestion is avoided. Both the feeding of logs and the removal of veneer can be automated.

The rotary planing table is simple to operate. The table is turned at a constant pre-selected rate by a variable speed, piston type hydraulic drive motor, or equivalent. An equivalent, alternative embodiment consists of a rotary drum type slicing device whereby wood products, small logs, split logs, bamboo culms, etc. are fed via vertical chutes to the cutting blades rotating below. The drum may be extended to provide additional cutting stations, and additional chutes can be attached radially to further increase output. Slightly offsetting the added cutting station radially and/or using an odd number of cutting blades will reduce cutting torque and machine shock by staggering blade impact forces.

DETAILED DESCRIPTION OF THE PREFERRED EMBODIMENTS

Figure 1:
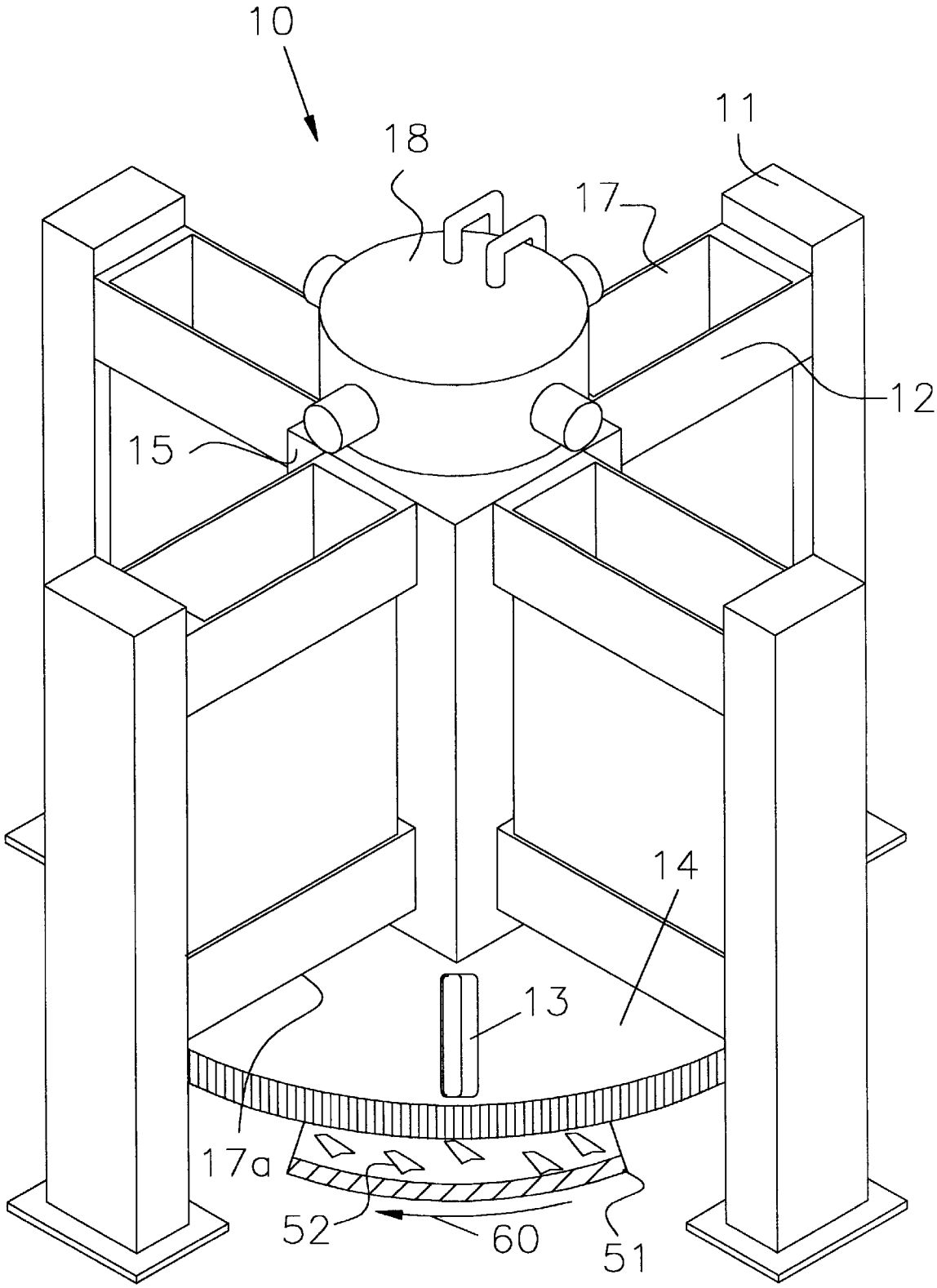
FIG. 1 is a perspective view showing the rotary planing table and its support arms and the blades set into the planing table.

Referring now to the drawings, wherein like numerals designate like and corresponding parts throughout the several views, in FIG. 1 the overall invention is designated by the numeral 10. Main supports 11 connect to spacers 12 and to central support 15 to position chutes 17 over rotary planing table 14 so that blades 13, moving in the direction of arrow 60 pass through chute bottom 17*a*. Hydraulic motor 18 provides the rotational force. Conveyer belt 51 collects veneers 52 as they fall through rotary planing table 14.

Figure 2:
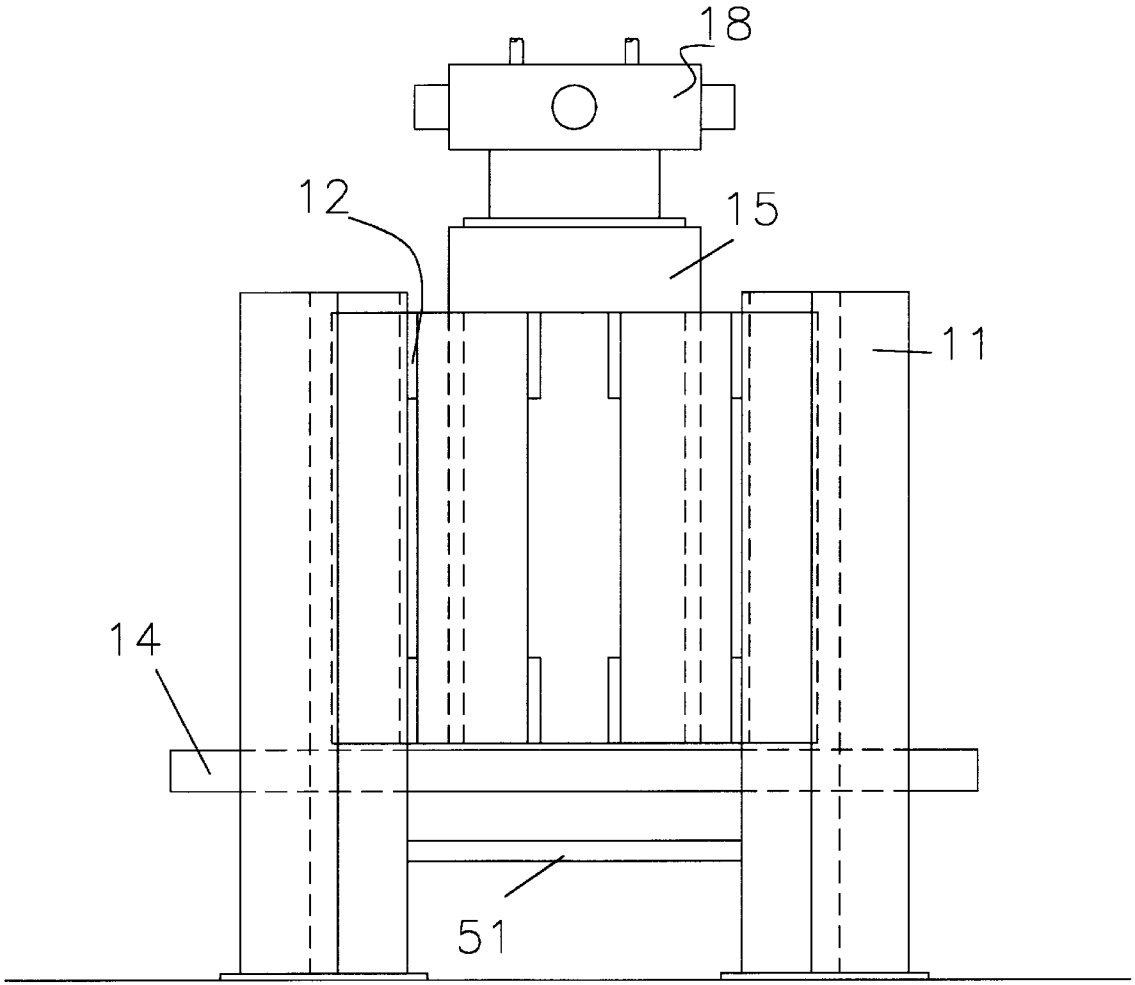
FIG. 2 is a front view showing the relationship between the drive motor, the support arms and the rotary planing table.

In FIG. 2, Hydraulic motor 18, is positioned at the proximal end of central support 15 and is suspended by spacers 12 connected to outer supports 11. Rotary planing table 14 is positioned at the distal end of central support 15 above conveyer 51.

Figure 3:
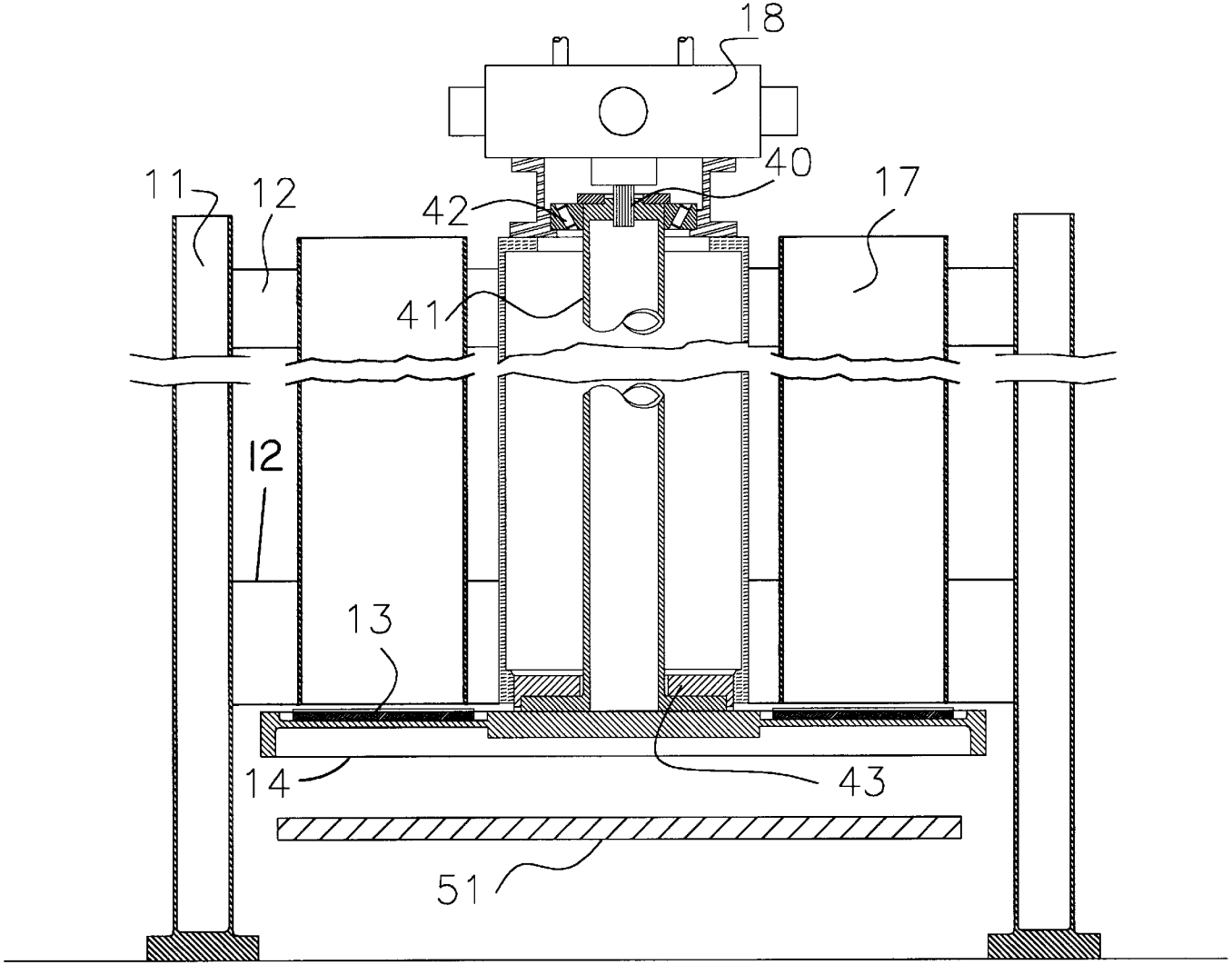
FIG. 3 is a front view, partly in section, showing the inner components of the main drive shaft and the bearing means by which the rotary planing table is revolved.

In FIG. 3 hydraulic motor 18 drives splined shaft 40 to turn main drive shaft 41 which is rotatably supported at its proximal end by bearing 42 and at its distal end by bushing 43, and which turns rotary table 14 and blades 13. Chutes 17 are held stationary over rotary planing table 14 by spacers 12 attached to support legs 11.

Figures 4, 4A:
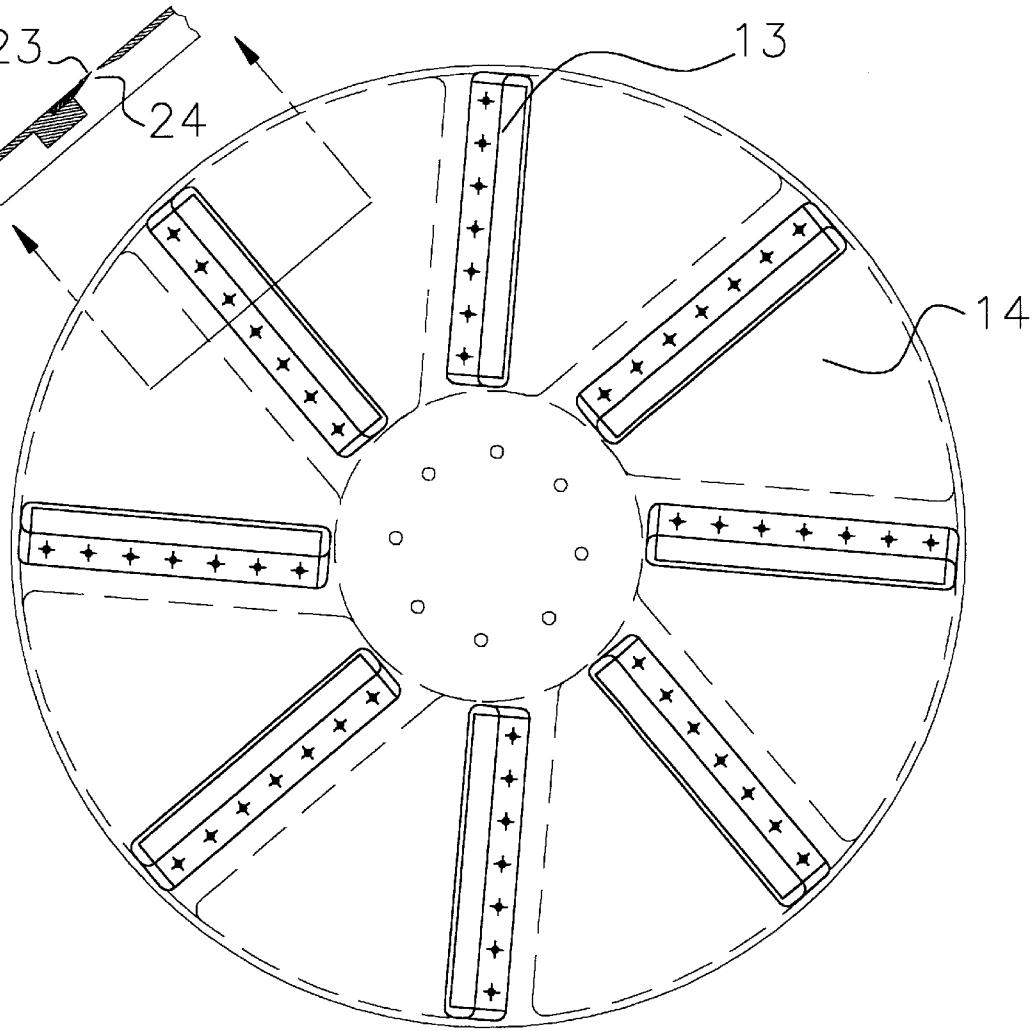
FIG. 4 is a top view of the planing table alone, showing the positions of the cutting blades.
FIG. 4*a* is a sectional view of one of the blades showing the cutting edge of the blade and the slot beneath through which veneers can pass through to the conveyer.

In FIG. 4, Blades 13 are radially arrayed on the proximal surface of rotary planing table 14. FIG. 4*a* shows the relative positions of cutting edges 23 and gaps 24 (see also FIG. 8 for enlargement).

Figure 5:
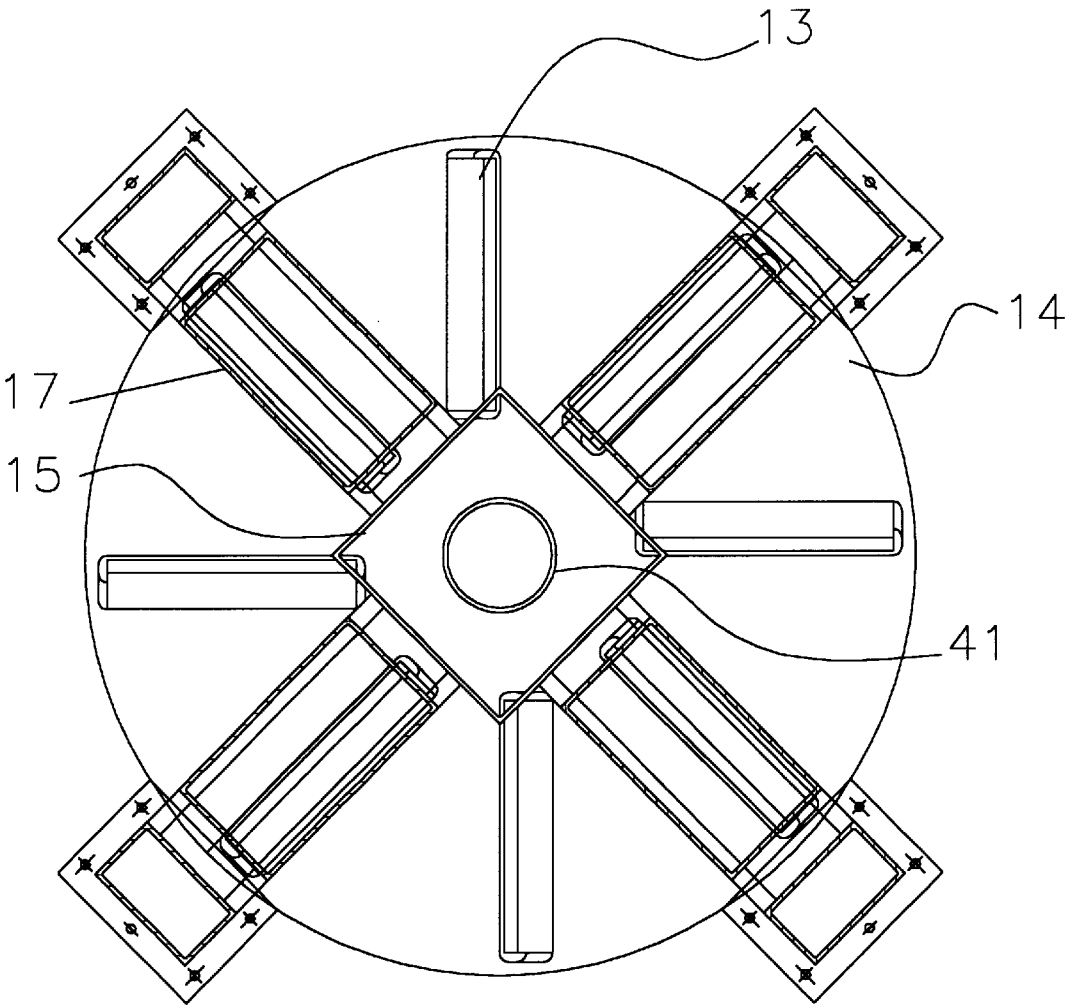
FIG. 5 is a top view partly in section showing the relationship between the outer support arms, the log chutes, the central drive shaft and the cutting blades.

FIG. 5 shows the relative positions of blades 13, chutes 17, central drive shaft 41, main support 15 and rotary planing table 14.

Figure 6:
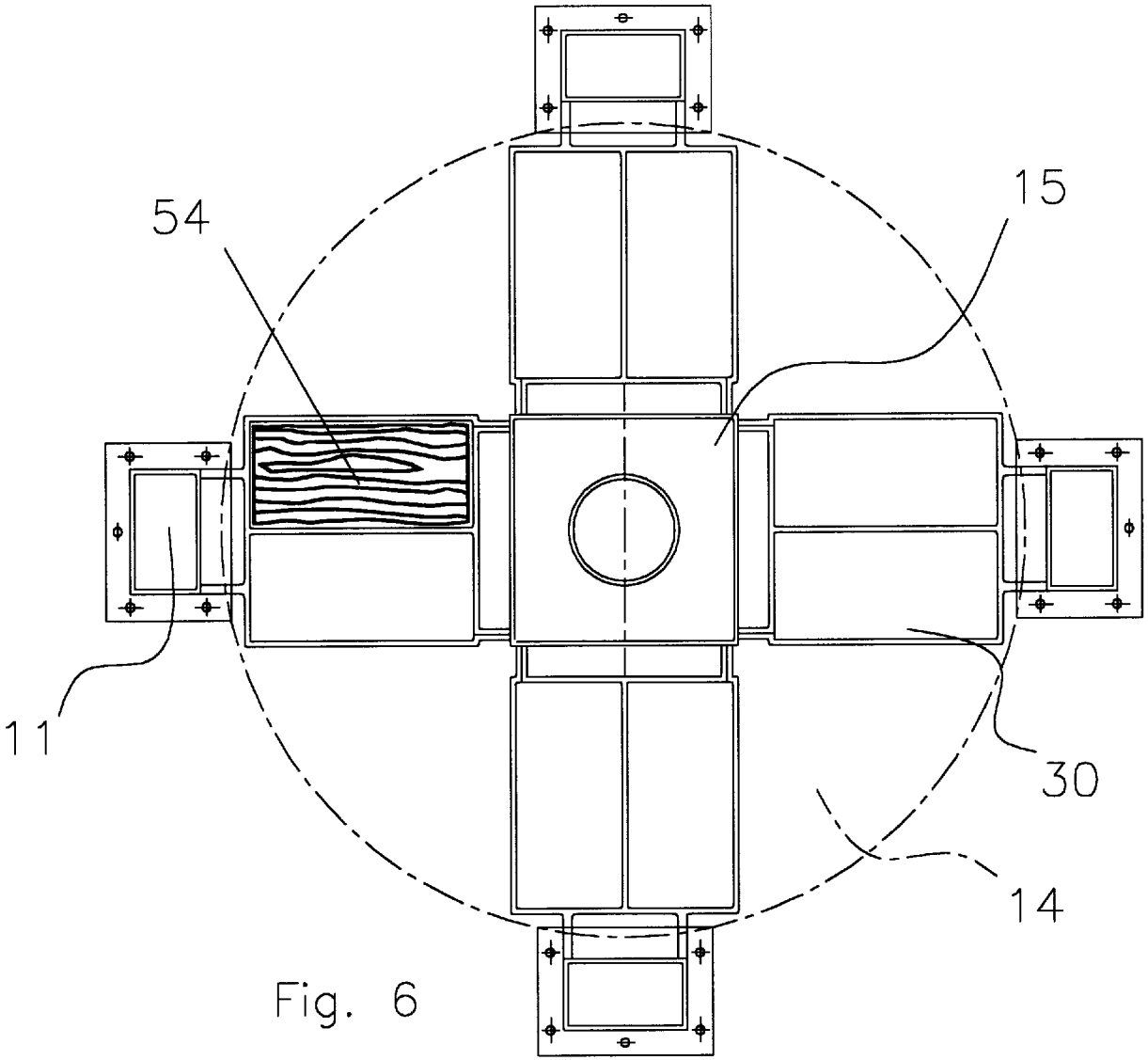
FIG. 6 is a top view illustrating an alternative chute arrangement for the veneering of short logs.
Figure 7:
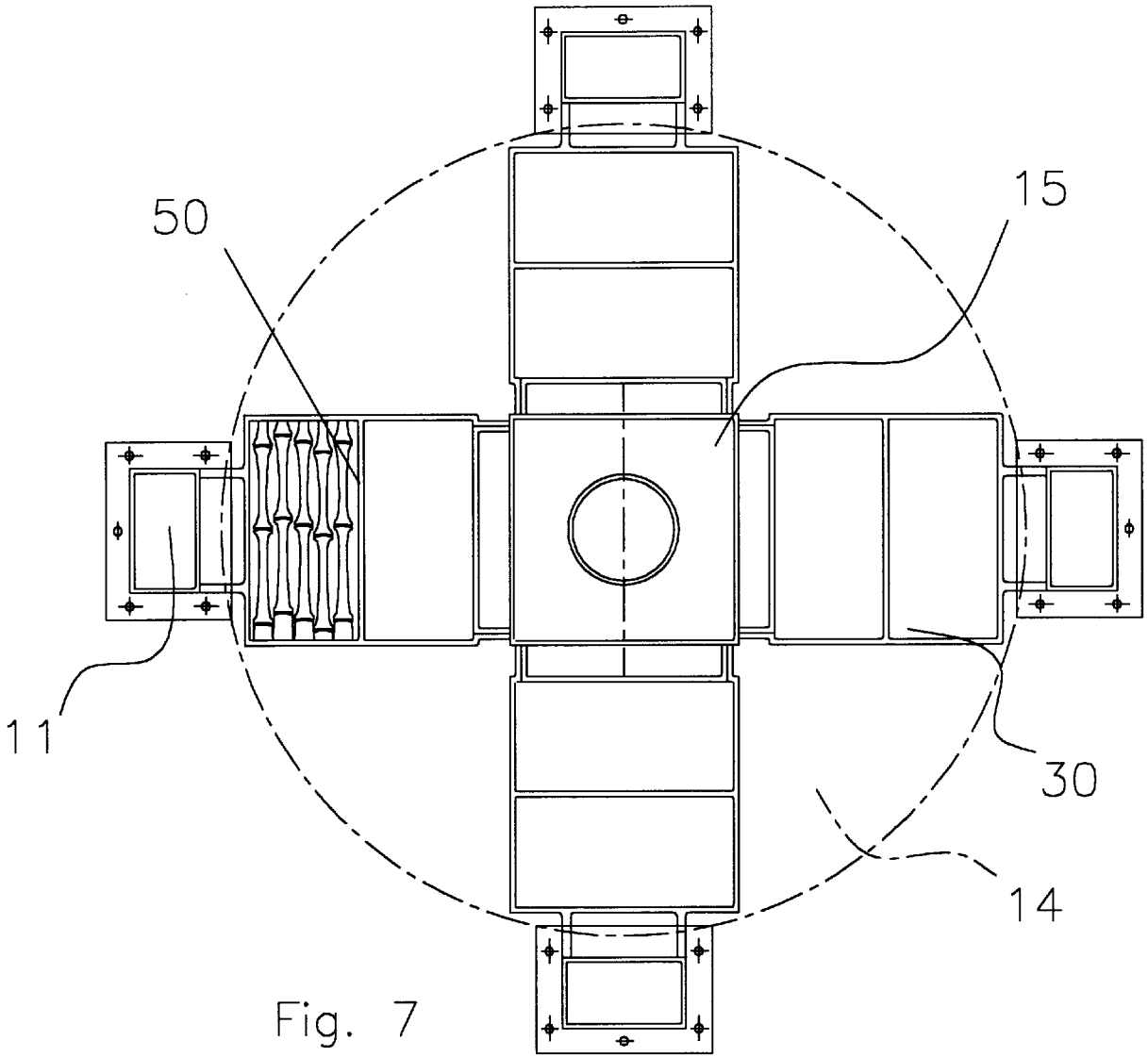
FIG. 7 is a top view illustrating an alternative chute arrangement for the veneering of bamboo culms.

FIGS. 6 and 7 show an alternative of chutes 30 wherein they hold logs 54 and bamboo culms 50 at different angles against the rotation of rotary planing table 14. In FIG. 7, the bamboo culms 50 are presented lengthwise to blades 13 to produce thin strips of veneer from along the length of the culms 50, whereas in FIG. 6, log 54 is presented crosswise to blades 13.

Figure 8:
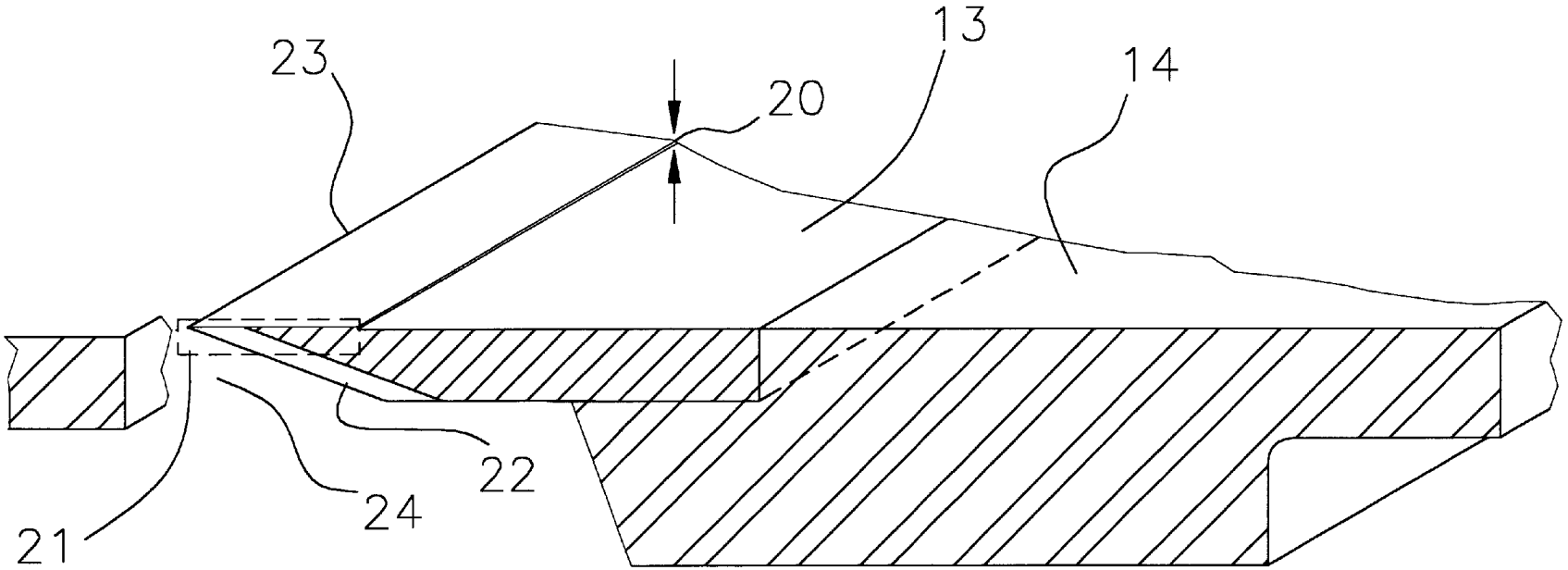
FIG. 8 is an enlarged sectional view of a cutting blade.

In FIG. 8, rotary planing table 14 holds blade 13 in place. Cutting edge 23 is sharpened back from the face 22 to maintain the cutting edge. Box 21 is where blade 23 can be reinforced with a hardened metal insert. Gap 24 is where veneers pass through rotary planing table 14. Blade height 20 regulates the depth of cut and is fully adjustable by using alternate blade 23 inserts.

Figure 8A:
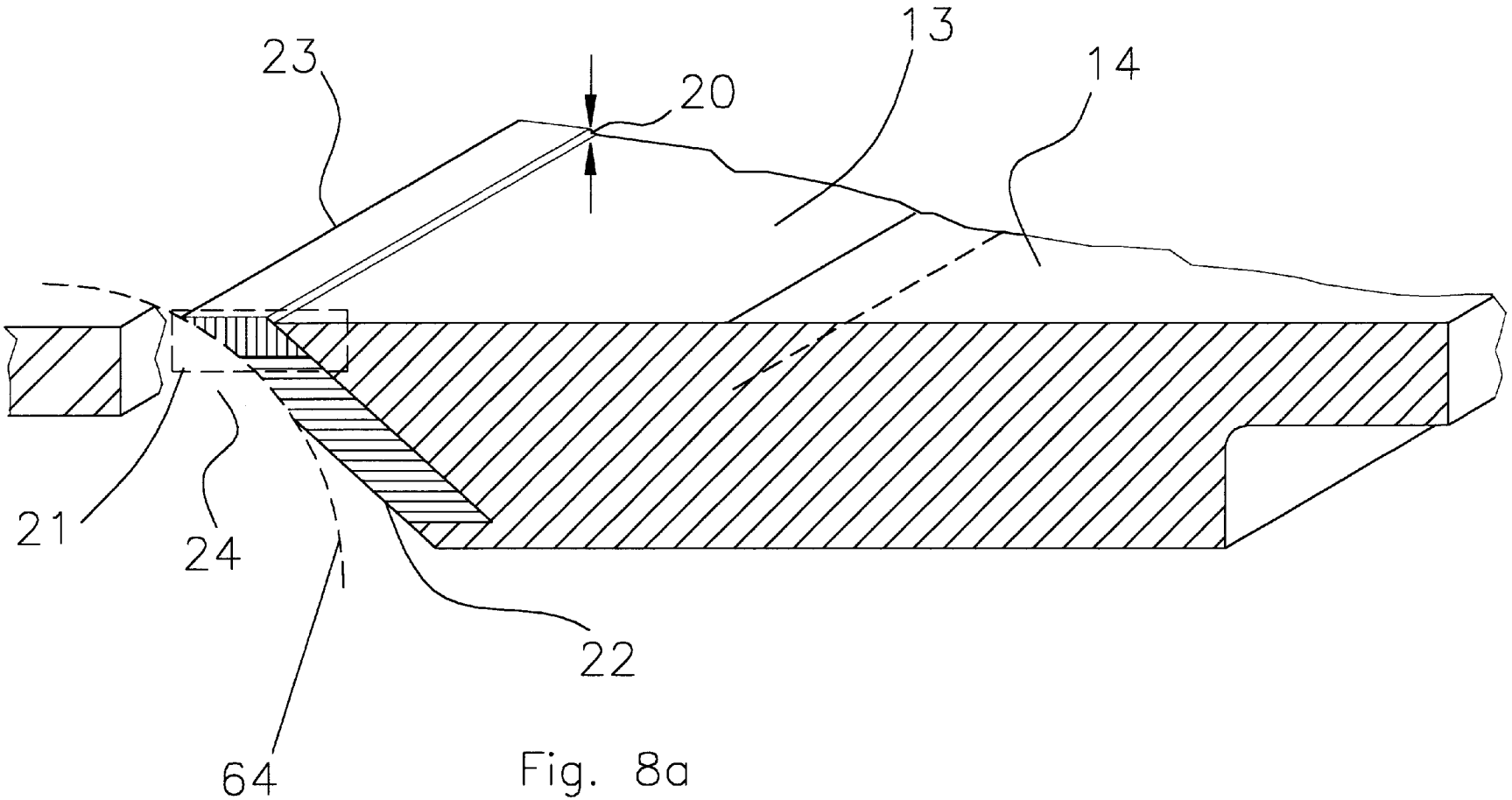
FIG. 8*a* is an enlarged sectional view of an alternative cutting blade.

The rotary planing table 14 is easy to operate. Rotary planing table 14 is turned by motor 18. Logs are loaded either manually or automatically into log feed chutes 17 as required. The feed chutes 17 position logs over rotary planing table 14 where the slicing blades 13 cut thin strips 52 from the bottom of the logs which fall to conveyer 51 or through a hole in the floor. Logs automatically feed down towards the cutting blades 13 as each is reduced to veneer. Waste is minimal. Blade 13 life is extended through the use of hardened inserts. Blades 13 are made to cut only one pre-selected thickness of veneer and can be quickly replaced. They are designed to maintain a constant depth of cut even after numerous sharpenings (FIGS. 8, 8A). By varying blade cutting depths, multiple thicknesses of veneers can be cut simultaneously. Cutting thickness can be varied from as thin as 0.0100 inches.

Figure 9:
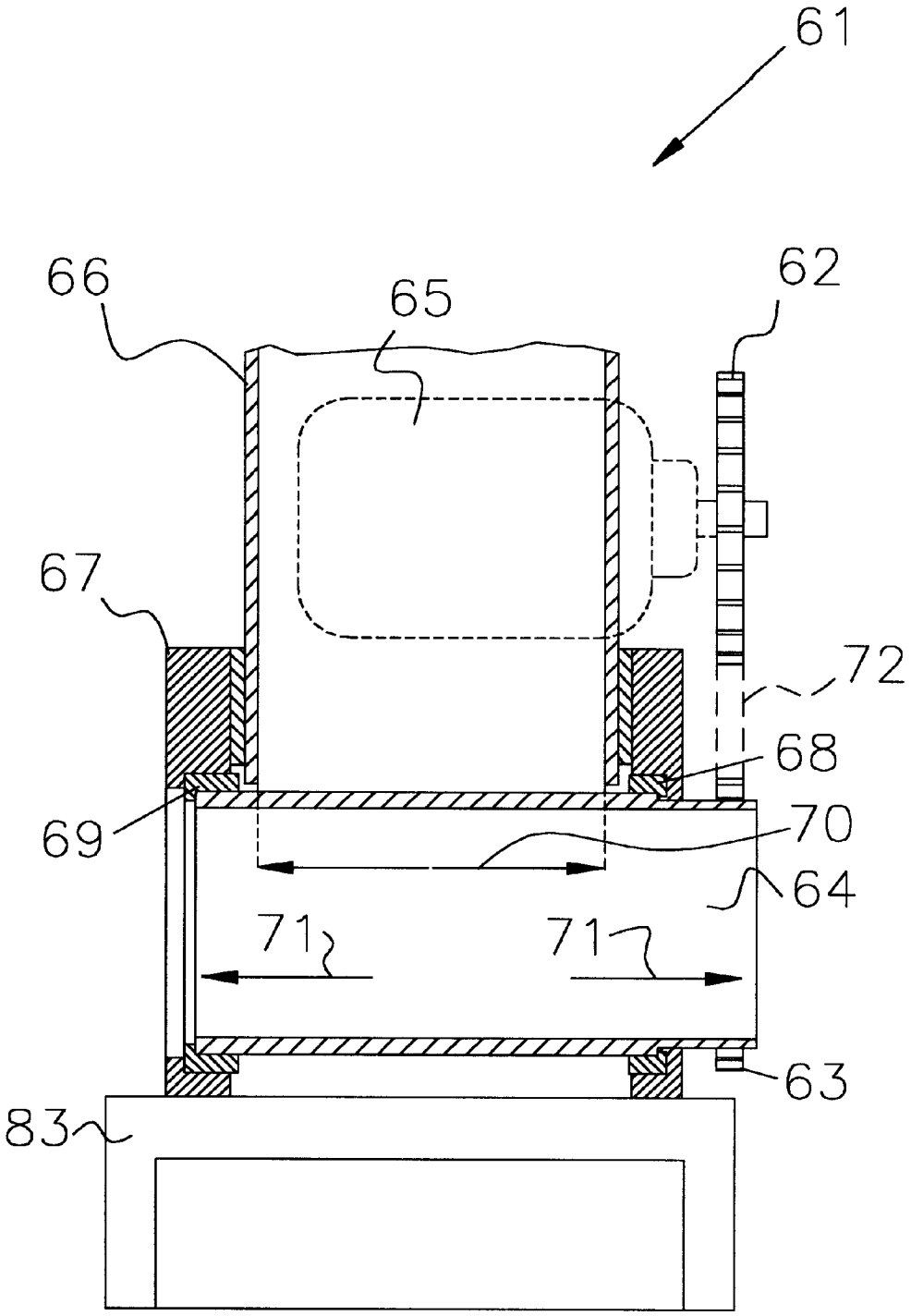
FIG. 9 is a side view of the alternative embodiment rotary drum cutter.

In FIG. 9, rotary drum cutter 61 is shown having chute 66 positioned above rotary drum 64 which is rotatably held by bushings 68 and 69 which are held in place by frame 67 and table 83. Motor 65 drives drum 64 through chain sprockets 62 and 63 which are connected by drive chain 72. The effective cutting area of the rotary cutting drum 64 is indicated by arrows 70 while the veneer discharge directions are shown by arrows 71.

Figure 10:
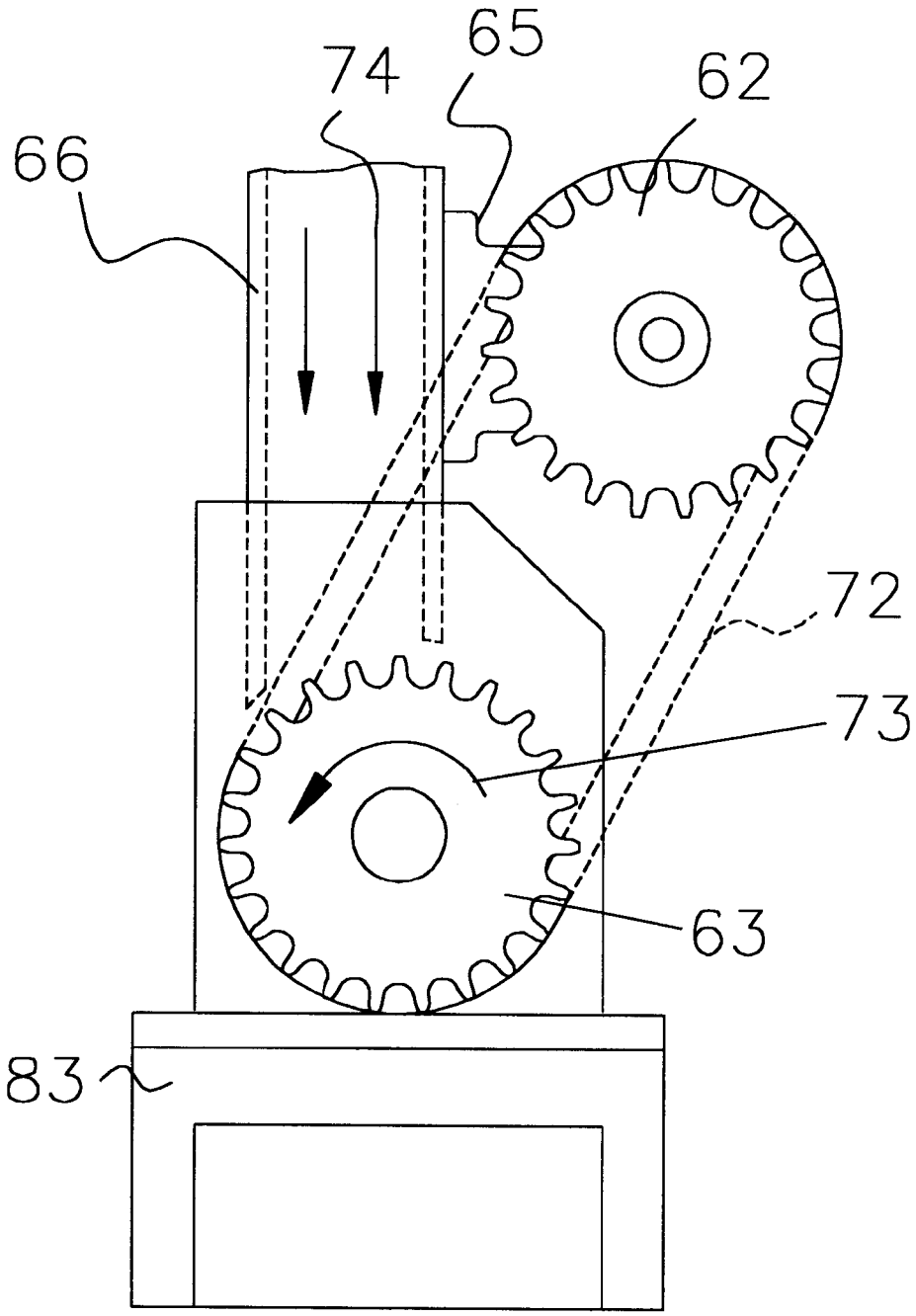
FIG. 10 is an end view of the same rotary drum cutter.

FIG. 10 shows the relative positions of feed chute 66, drive motor 65, and drive sprockets 62 and 63. Rotational direction of the cutting drum 64 is indicated by arrow 73 while arrow 74 indicates the direction of feed toward the rotary drum 64.

Figure 11:
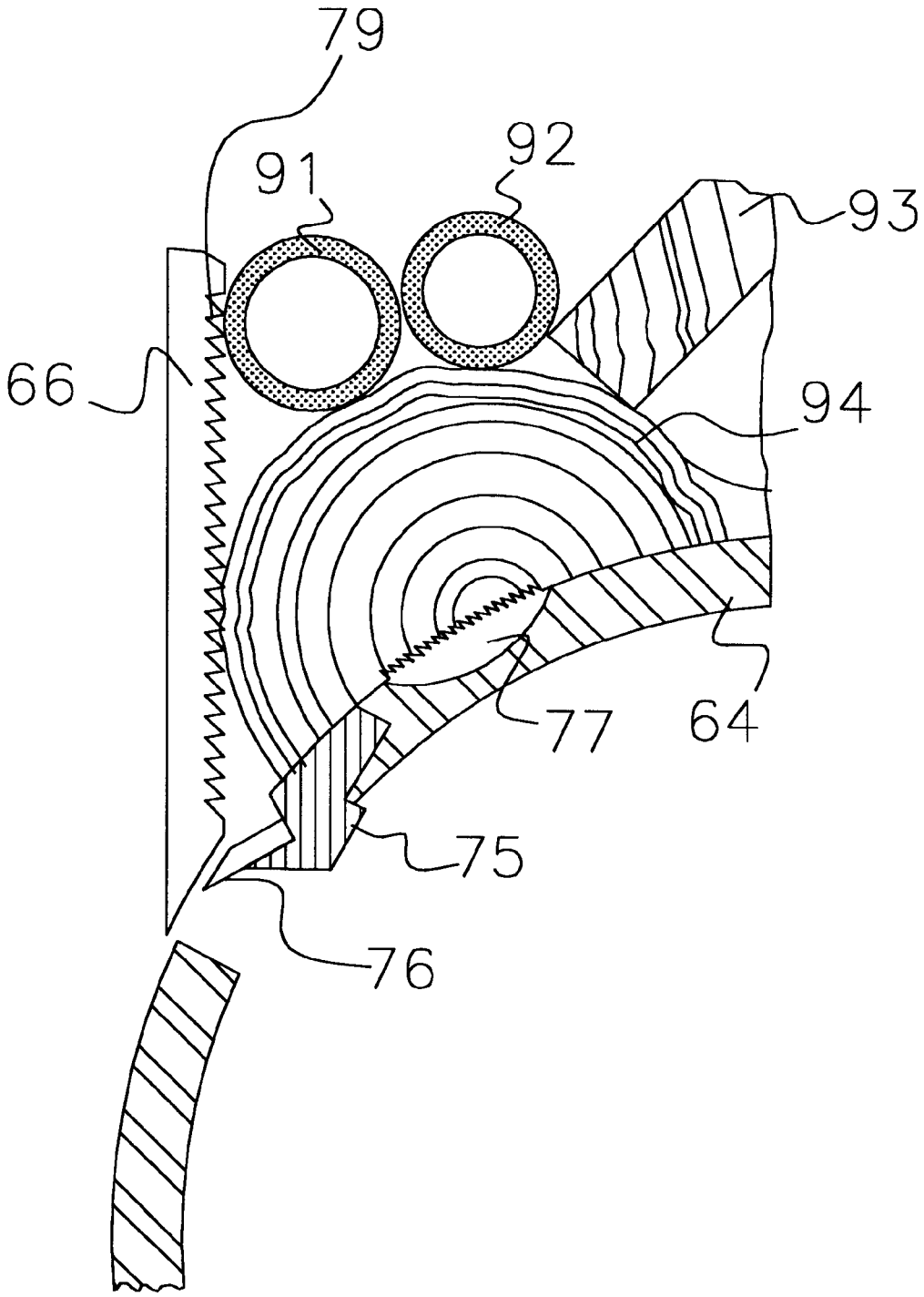
FIG. 11 is an enlarged side view, partly in section, showing the component parts of the rotary cutter as they would appear while in operation.

In FIG. 11, chute wall 66 has serrated teeth 79 to grip log 94 and hold it against the rotation of rotary drum 64. This view shows an optional slitter blade 77 approximately 0.03 inches wide to slit veneer to the required length as it is stripped from log 94. Numerals 91, 92 and 93 show the different wood products and sizes which can be accommodated by the rotary cutter drum 64.

Figure 12:
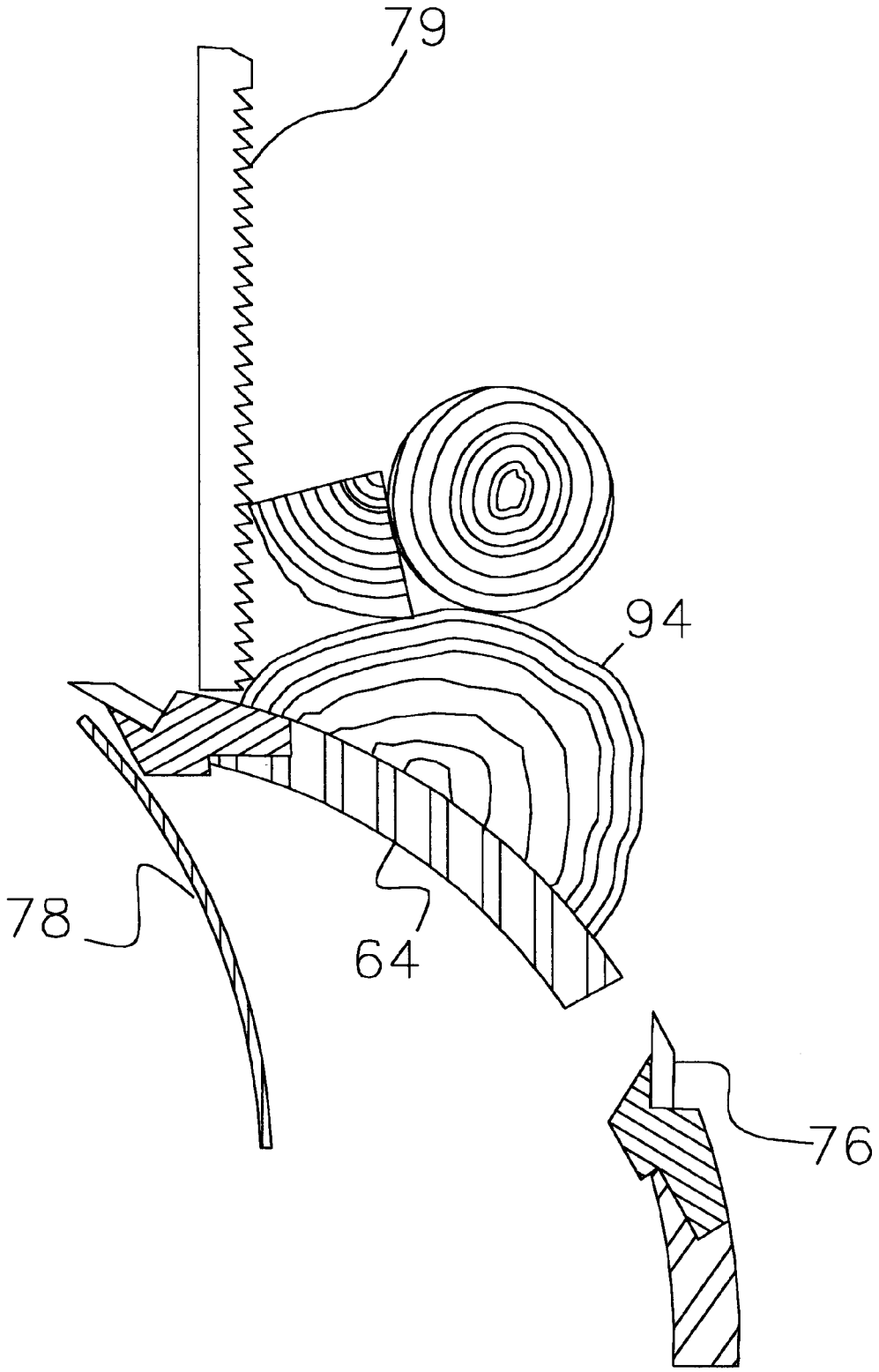
FIG. 12 is an enlarged side view partly in section showing the rotary cutter removing a thin veneer from a log.

In FIG. 12, veneer strip 78 is removed by blade 76 from log 94, again held by serrations 79 against the rotation of cutting drum 64. The veneer strip 78 falls inside the rotary drum 64 for discharge as described in FIG. 9.

Figure 13:
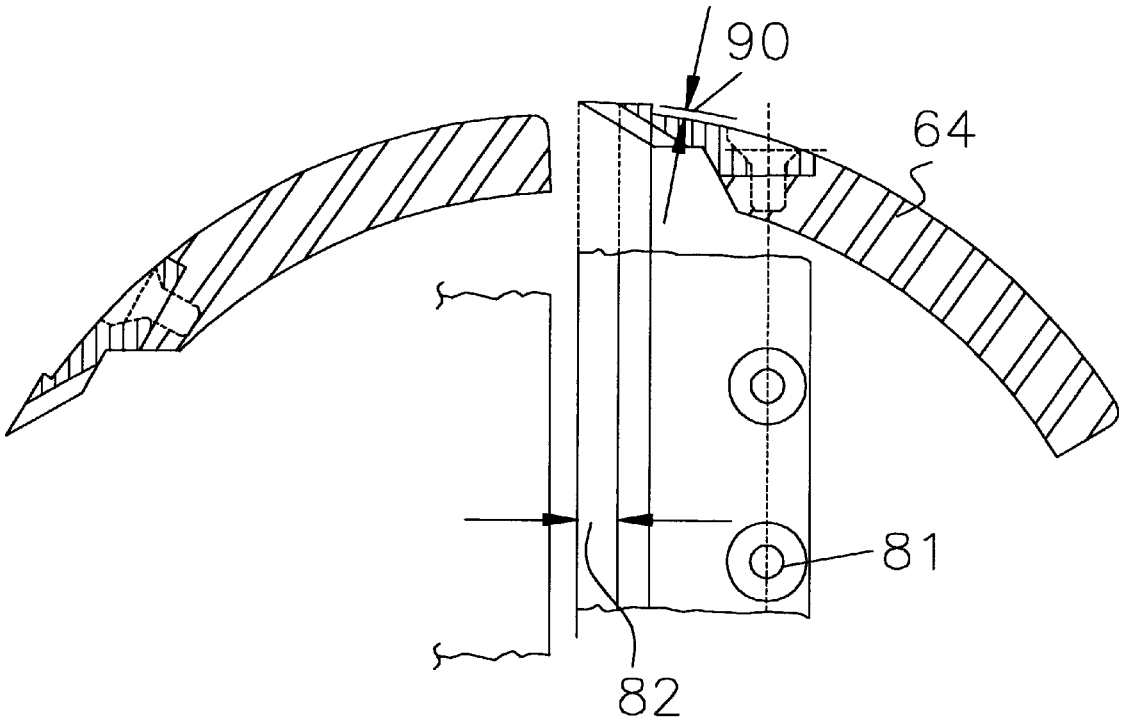
FIG. 13 is a combination side and top view, partly in section, showing the component parts of the constant depth of cut veneering blade.

In FIG. 13, depth of cut 90 is set at 0.050, which remains constant regardless of re-sharpening materials loss shown between arrows 82. Removing the material moves the cutting edge back along the axis of cutting drum 4 but does not alter cutting height 90.

Following is an example of potential production of product by the invention.

With four feed chutes and eight cutting blades using logs approximately 12 inches in diameter and 24 inches in length and table rotation is set at 120 revolutions per minute. The volume of a log of those dimensions is 1.57 cubic feet. There are approximately 192 slats of a thickness of 0.0625 in such a log. At 120 R.P.M. it takes approximately 12 seconds to slice through the log and during one minute of operations, five such logs can be processed per chute for a total of 20 logs per machine per minute. This is equivalent to 31.4 cubic feet (0.889 cubic meters) per minute, giving a theoretical output of 53.3 cubic meters per hour, or 426 cubic meters per eight hour shift.

Production can be increased by:

(1) Increasing the table speed (RPM)

(2) Use of twin (side by side) log feed chutes or additional chutes (3) Increase the number of cutting blades, (4) Increase veneer thickness, and (5) Increase the log size and length.

The rotary planing table of the invention produces a more valuable product than other means because it produces a veneer sheet in which the wood fiber retains all the structural and physical properties inherent in the original log. The large veneer slats can be readily split and cut to length for processing into a variety of manufactured wood products which are stronger and tougher than their solid wood counterparts. The rotary planing table can convert timber having limited commercial value into useable veneers.

The products of this invention are fully interchangeable with current building materials such as dimensional lumber, sheeting, beams, etc. These veneer based products have the additional advantages of uniform quality, are of structural grade, and less costly to produce.

This invention also makes possible a new era of "modular" building construction. It will be practical to mass produce standardized, semi finished modules for floors, walls, roofs, ceilings, etc. Veneer sheeting and framing can be bonded efficiently into rigid, low cost, load bearing structures. These modules lend themselves to such construction projects as motels, condominiums, strip malls, school class rooms and utility buildings.

The instant invention can thereby affect the future and fortunes of the lumber industry and help it adapt to a "modular" age. Although the invention uses modern machinery and technologies, it has its genesis in the ancient quest to find commercial uses for bamboo. Bamboo grasses are the fastest growing and the strongest plant fibers in the world and now with the rotary planing table machine of the invention, it is economically practical and profitable to process bamboo culms into useful building products. Future advances in plant genetics, cultivation, and mechanized harvesting could make bamboo the construction fiber of the future.

Of course, it should be understood that a wide range of changes and modifications can be made to the preferred embodiment described above. It is therefore, intended that the foregoing descriptions be regarded as illustrative rather than limiting, and that it can be understood that it is the following claims, including all equivalents, which are intended to define the scope of the invention.

What is claimed is:

1. A system for converting small diameter, short logs, and split logs into viable base construction materials without generating waste, said system comprising:

a support structure having a plurality of outer legs supporting a central structure, said central structure having a low speed, high torque, motor driving a first end of a central drive shaft, said drive shaft having a planing table rotatably attached to a second end, said planing table having a plurality of blades radially arranged on said planing table, each of said blades having a cutting edge and each of said blades having a narrow slot formed beneath said cutting edge, a plurality of feed chutes, each having an open top end and a bottom end, said feed chutes radially attached to said support structure and having each of said open bottom ends positioned over said plurality of blades arranged on said planing table, and removal means positioned beneath said planing table for collecting and transferring the base material for further processing.

2. A system for converting small diameter, short logs and split logs, into viable base construction materials as described in claim 1 wherein said removal means comprises a conveyer belt for collecting veneered base material.

3. A system for converting small diameter, short logs and split logs, into viable base construction materials as described in claim 1 wherein said base material consists of logs presented crosswise to said cutting blades.

4. A system for converting small diameter short logs and split logs, into viable base construction materials as described in claim 1 wherein said base material consists of bamboo culms presented lengthwise to said cutting blades.

5. A system for converting small diameter, short logs, and split logs, into viable base construction materials as described in claim 1 wherein the cutting edge of said cutting blades is sharpened from the face to maintain the cutting edge after numerous sharpenings while retaining the cutting depth.

6. A system for converting small diameter, short logs and split logs, into viable construction materials without generating waste, said system comprising:

a support structure having a plurality of outer legs supporting a central structure, a rotary drum cutter mounted on said support structure, said drum cutter having a frame, a rotary drum rotatably held by bushings mounted on said frame, affixed to said table, a plurality of cutting blades around the periphery of said drum cutter, a drive sprocket affixed at a first end of said drum, a chute being mounted vertically on said base, said chute being positioned above said rotary drum, said chute having an inner wall having a series of serrated teeth formed thereon for gripping said base material, a motor being mounted on said chute, said motor having a drive sprocket mounted thereon, a drive chain connecting said drum sprocket and said motor drive sprocket, for rotating said rotary drum cutter and thereby veneering said base material, and removal means positioned beneath said rotary drum cutter for collecting and transferring the base material for further processing.

7. A system for converting small diameter, short logs and split logs, into viable construction materials of claim 6 wherein a slitter blade is mounted on said rotary drum cutter for slitting said base material veneer to required lengths.

* * * * *